United States Patent [19]

Giebmanns

[11] Patent Number: 4,524,545

[45] Date of Patent: Jun. 25, 1985

[54] GRINDING MACHINE

[75] Inventor: Karl-Heinz Giebmanns, Westport, Conn.

[73] Assignee: ITM International Tool Machines Inc., Westport, Conn.

[21] Appl. No.: 551,715

[22] Filed: Nov. 15, 1983

Related U.S. Application Data

[63] Continuation-in-part of Ser. No. 284,410, Jul. 17, 1981, Pat. No. 4,468,892.

[51] Int. Cl.[3] ..... B24B 7/00

[52] U.S. Cl. ..... 51/99; 51/165.77; 51/34 D

[58] Field of Search ..... 125/13 R, 13 SS; 51/98, 51/99, 165.8, 165.81, 165.87

[56] References Cited

U.S. PATENT DOCUMENTS

| | | | |
|---|---|---|---|
| 2,693,057 | 11/1954 | Eastwood | 51/98 R |
| 2,998,812 | 9/1966 | Cooper | 125/13 SS |
| 3,562,959 | 2/1971 | Dooley | 51/99 |
| 3,641,709 | 2/1972 | Gazuit | 51/99 |
| 4,020,598 | 5/1977 | Harmant | 51/165.87 |

*Primary Examiner*—Harold D. Whitehead

[57] ABSTRACT

An improved grinding wheel support arrangement in a grinding machine. The support arrangement includes a support table on which a first post is threadably mounted in a direction normal to the support table. A pair of second posts is fixedly mounted on the support table at a predetermined distance from the first post. A first support shaft is rotatably mounted in the pair of second post by means of a pair of tapered roller bearings. A second support shaft is rotatably mounted in the housing also by means of a pair of tapered roller bearings. An intermediate member is respectively fixedly connected at its opposite ends to said first and second support shafts. A grinding wheel shaft is rotatably mounted in the housing and a grinding wheel is coaxially mounted on the grinding wheel shaft. The first post is connected to the grinding wheel shaft so as to permit its free rotation but also so as to determine its position relative to the support table. The first post is connected to a DC current motor for advancing or retracting the first post on the support table. A drive motor for driving the grinding wheel shaft is mounted on the housing in such a way that its center of gravity is substantially aligned with the first and second support shafts.

10 Claims, 5 Drawing Figures

GRINDING MACHINE

CROSS-REFERENCE TO RELATED APPLICATION

This application is a continuation-in-part application of my copending application Ser. No. 284,410, filed July 17, 1981, and now U.S. Pat. No. 4,468,892, issued Sept. 4, 1984 for AN IMPROVED GRINDING MACHINE.

BACKGROUND OF THE INVENTION

The invention relates to an arrangement of supporting and guiding various axles, plates, housings, shafts, etc. of a grinding machine, whereby the support and guidance is carried out with an improved precision.

Grinding machines of the type described herein are used for grinding of, for example, slots, threads, exterior and interior diameters of front surfaces of workpieces.

In a prior embodiment of a grinding machine the grinding wheel support arrangement includes a support frame or housing on which a support member is pivotally connected with one of its free ends. A support leg or housing is pivotally mounted on the support member at the other free end. A grinding wheel shaft, on which the grinding wheel is coaxially mounted, is rotatable in the support leg or housing. At least two separate adjusting means are operatively connected to the support frame. One of these adjusting means is pivotally connected at the support member and the other adjusting means is pivotally connected to the support leg for adjusting the position of the grinding wheel relative to the support frame. Consequently two separate adjusting means act in the plane of the grinding wheel in mutually intersecting directions. It has, however, been ascertained that such a grinding wheel support arrangement really only requires one primary separate adjusting means to effect a precise positional adjustment of the grinding wheel with respect to a workpiece to be ground and more importantly maintain this precise adjustment.

In an alternate version of my prior grinding wheel support arrangement a post is provided on the support frame on which an intermediate arm is pivotally mounted with one of its free ends. The other free end of the intermediate arm is connected to the support leg or housing, which rotatably supports the grinding wheel. This grinding wheel support arrangement also includes two adjusting means. A first adjusting means is in the form of a hydraulic piston cylinder mounted on the support frame which acts in a direction normal to the support table. This piston cylinder supports a frame which includes a second hydraulic or pneumatic adjusting means which in turn is directly connected to the axial bearing supports of the grinding wheel. These axial bearing supports are in turn mounted in the housing. Here again, a two-directional adjustment is used for precisely positioning the grinding wheel vis a vis a workpiece and to maintain it in this precisely adjusted position.

It has been found such such bi-directional adjusting means of the grinding wheel support arrangement do not give sufficiently precise adjustments of the grinding wheel vis a vis a workpiece.

SUMMARY OF THE INVENTION

It is therefore a main object of this invention to provide a grinding wheel support arrangement in which the grinding wheel is capable of being positioned precisely vis a vis a workpiece and, more importantly, this precise positioning is capable of being maintained by hydraulic clamping means to improve the reproducibility capabilities of the grinding machine.

The novel grinding wheel support arrangement of this invention includes as the principal adjusting means a first post which can be reciprocally moved in a direction normal to the support table by gear and/or thread adjusting means. This first post supports a housing in which the bearings for the grinding wheel drive shaft are mounted. These bearings are substantially coaxially aligned with respect to the longitudinal axis of the first post. In a manner similar to my prior inventive grinding wheel support arrangement a second fixed post pivotally supports an intermediate member which is in turn pivotally connected to the housing in which the bearings for the grinding wheel shaft are mounted. This housing is also supported directly on the hydraulic piston cylinder via a member that is mounted on the grinding wheel shaft. The roller bearings for the grinding wheel shaft are disposed in axial alignment with the hydraulic piston cylinder.

BRIEF DESCRIPTION OF THE DRAWING

With these and other objects in view, which will become apparent in the following detailed description, the present invention will be clearly understood in connection with the accompanying drawings, in which.

DETAILED DESCRIPTION

Figure 1:
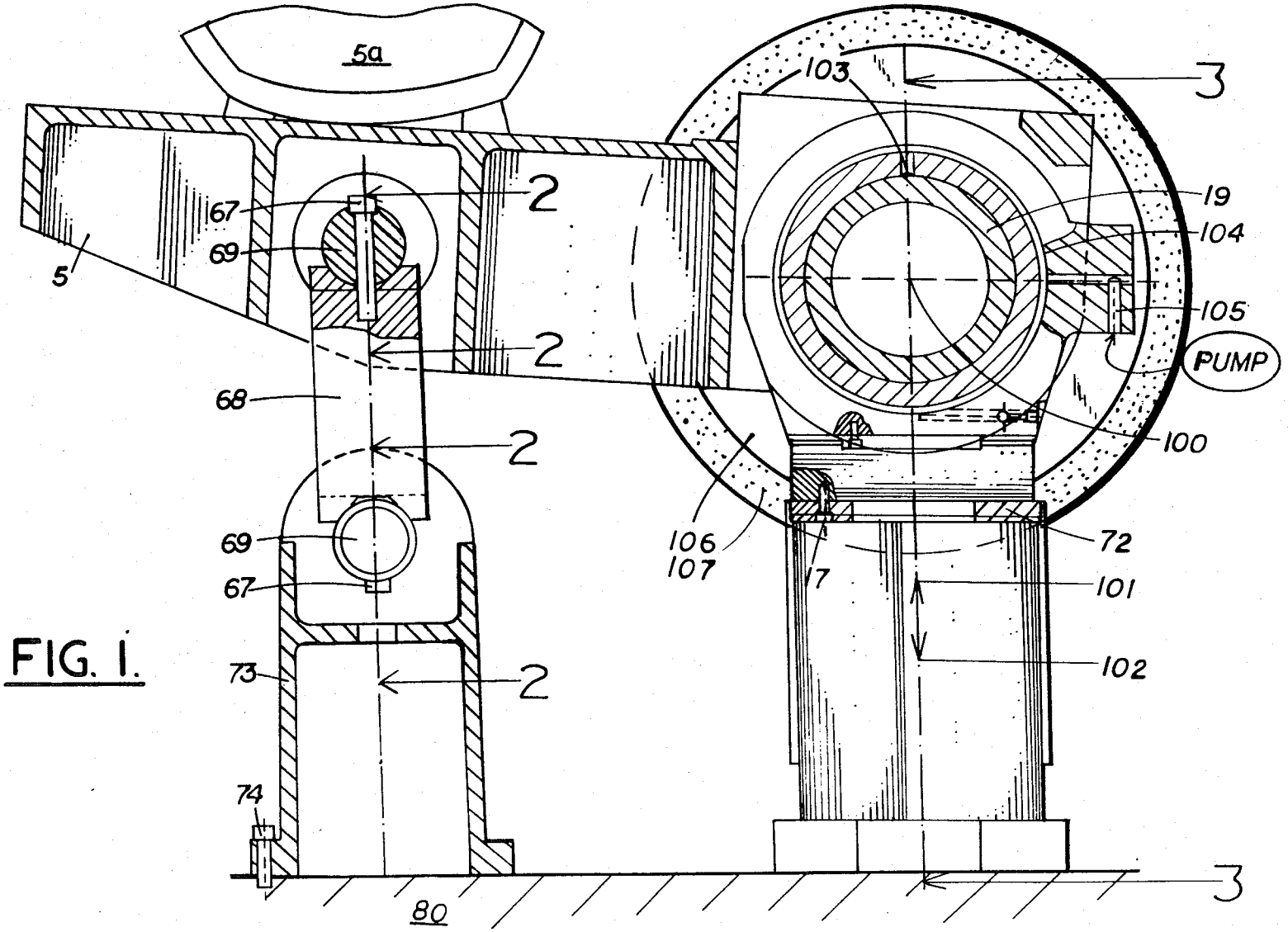
FIG. 1 is a side-elevational view of the grinding wheel support arrangement of this invention in which certain parts are shown in cross-section.
Figure 2:
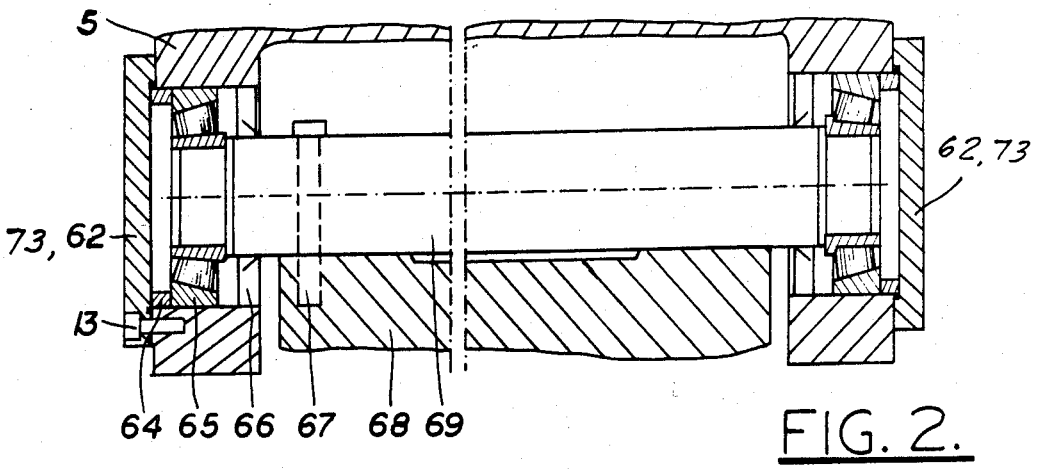
FIG. 2 is a cross-sectioal view along lines 2—2 of FIG. 1 which view respectively shows the pivot connection between the intermediate member and the second fixed post, on the one hand, and the housing, on the other hand.

Referring now to the drawings there is illustrated in FIG. 1, in side-elevation, the main components of the grinding wheel support arrangement. A housing 5 is connected via a shaft 69 and an intermediate member 68 to the second fixed posts 73 which are mounted on the support table 80 by means of screw bolts 74. As can be noted, the housing 5 is connected by way of the shaft 69 and bolts 67 to the intermediate member 68. As shown in FIG. 2, this shaft 69 is supported by a first pair of tapered bearings 65 in the housing 5. The intermediate member 68 rides on the shaft 69 so as to provide a smoothly operating pivotal connection. Similarly, the tapered bearings 65 provide for a smooth yet precise pivot connection between the intermediate member 68 and the housing 5. The tapered bearings 65 remove any play in the pivot connection but at the same time permit a pivotal movement of the main housing 5 about the axis of the shaft 69. The tapered bearings are pretensioned by means of the rings 64 and the cover 62 mounted with threaded bolts 13 thereby removing any possible appreciable play. Sealing rings 66 are provided for preventing any penetration of any dirt or dust into the tapered bearings. As can be seen in FIG. 1, a motor 5*a* is mounted on the pair of support legs of the housing 5 so that its center of gravity is essentially in alignment with the intermediate member 68 and the second posts 73. An analogous connection is provided between the pair of posts 73 and the intermediate member 68, that is a second pair of tapered bearings are mounted in the posts 73 and support a shaft 69 which is connected by means of threaded bolts 67 to the intermediate member 68. Here too, as in FIG. 2, the tapered bearings 65 are pretensioned by means of rings 64, a plate 62, and threaded bolts 13. In this case, however, the tapered bearings 65 are mounted in the posts 73. As stated hereinabove, the posts 73 are fixedly connected to the support table 80 by means of threaded bolts 74.

In order to achieve a grinding operation of very high precision, it is necessary to provide the pivot points about the shaft 69 so that the support legs of housing 5 move reciprocally vertically along the center line in the double-arrow direction 101–102 at the rotational axis 100. When the housing 5 moves in the double-arrow direction 101–102 then the arrangement of the double pivot points at the shafts 69 serves to compensate for this vertical movement without imparting any play to the support bearing 19. Moreover, the novel grinding wheel support arrangement of this invention makes for a more stable construction. In particular, the support legs of the housing 5 are more stably supported. This is particularly so in view of the fact that the drive motor 5*a* is mounted on the housing 5 in such a way that its center of gravity is disposed substantially above the axis of the second posts 73. In this connection it must be considered that it is very important for a precise operation of the grinding machine that the grinding wheel for grinding a workpiece is capable of a multitude of adjusting movements which must be carried out with great precision. It is for this reason that it is important to mount to drive motor (which may be quite massive depending on its size) above the pivot points of the shafts 69. When so mounting the drive motor 5*a* its weight is carried by the tapered bearings 65 and therefore influences only minimally the precise positioning of the flange 106 and grinding wheel 107 in the direction of the double-arrow 101–102.

Figure 3:
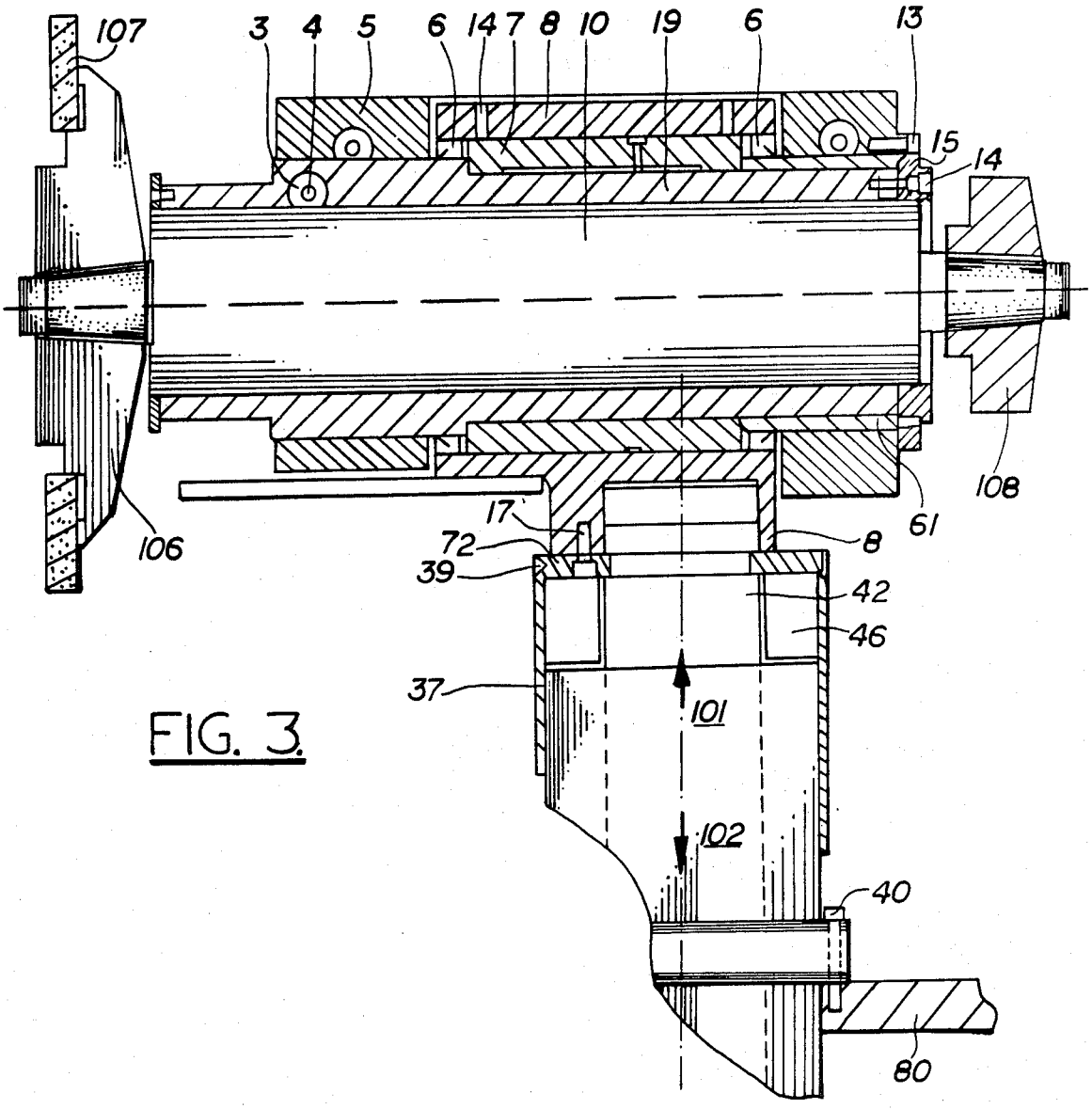
FIG. 3 is a partial side-elevational view along line 3—3 of FIG. 1.

FIG. 3 illustrates in side-elevation the grinding wheel support arrangement of this invention and indicates the vertical adjustment of the grinding wheel in the direction of the double-arrow 101–102. The grinding wheel spindle shaft 10 is that of a conventional grinding wheel spindle, which carries at its left end a flange 106 on which a grinding wheel disc 107 is coaxially mounted. At the right end of the spindle shaft 10 there is mounted a belt pulley 108 for driving the spindle shaft 10. The spindle shaft 10 is mounted in a spindle bearing 19 and is clampingly held in its driving position by the clamps 3,4. The spindle bearing 19 (spindle housing) is directly mounted in the support legs of the main housing 5 and is secured at its left side in the spindle housing by means of clamps 3,4. The right side of the spindle housing 19 is, for purposes of a sound mounting, supported by means of an auxiliary ring 61, an end plate 15 and the threaded bolts 13 in the main housing 5 where it is fixedly mounted.

The spindle housing 19 is surrounded in its middle region by a support bearing cylinder 7 which is pressed in a separate housing 8 and is secured therein by means of threaded bolts or screws 14. A pair of sealing rings 6 are provided at both ends of the housing 8 and these sealing rings serve to prevent the penetration of dirt and dust into the bearing surfaces of the corresponding housings. A guide shaft 42 is pressed into the housing 8 and is prevented from falling out by means of pressure plates 72 and threaded bolts 17. A protective ring 37 is mounted by means of screws 39 on the pressure plate 72 which protective ring has the task to prevent a direct impingement of dirt onto the guide shaft 42.

This guide shaft 42 is mounted in a guide sleeve 46 for purposes of a vertical slidable movement in the direction of the double-arrow 101–102. During the movement of the guide shaft 42 in a vertical direction, the spindle 10 and grinding disc 107 also move in a vertical direction. This movement constitutes the grinding position adjustment and must be carried out with great precision in high precision grinding machines. By providing the rear (left) portion of the main housing 5 with tapered bearing supports 65, there occurs, a vertical movement of the main housing 5 at the grinding side, a slight rotational movement between the spindle housing 19 and the support sleeve 7. In order to achieve a maximum precision during the grinding of a workpiece by means of the grinding wheel support arrangement of this invention, it is necessary to eliminate during the last operational step the play between the spindle housing 19 and the support sleeve 7. This play is necessary when positioning the individual grinding wheel relative to the workpiece in order to permit the rotational movement between the spindle housing 19 and the support sleeve 7, respectively, and to permit the vertical adjustment of the shaft 42 in the direction of the double-arrow 101–102. After a large number of chips have been removed from the workpiece, this play, however, is undesirable at the last operational step at the workpiece.

For this reason, as shown in FIG. 1, there is provided in the grinding wheel support arrangement of this invention, at the upper side of the support sleeve 7, a pocket 103. It has been found advantageous to provide this pocket 103 at the upper side of the support sleeve 7 because this position is opposite to the position at which all forces act in a vertical direction. By means of a ring channel 104 and the inlet bore 105 there can be effected at a desired moment in point of time a pressure (preferably in the form of oil pressure) at the pocket 103. By means of this oil pressure there is exercised on the spindle sleeve 19 a force, depending on the size of the cross-section of the pocket 103, which is transferred to the lower side of the support sleeve 19 by virtue of which and jointly with the gravitational force the spindle 19 is at all times bearing with an additional force against the support sleeve 7. By means of such a system the entire grinding head is stabilized and a higher degree of precision and reproducibility is thereby attained.

Figure 4:
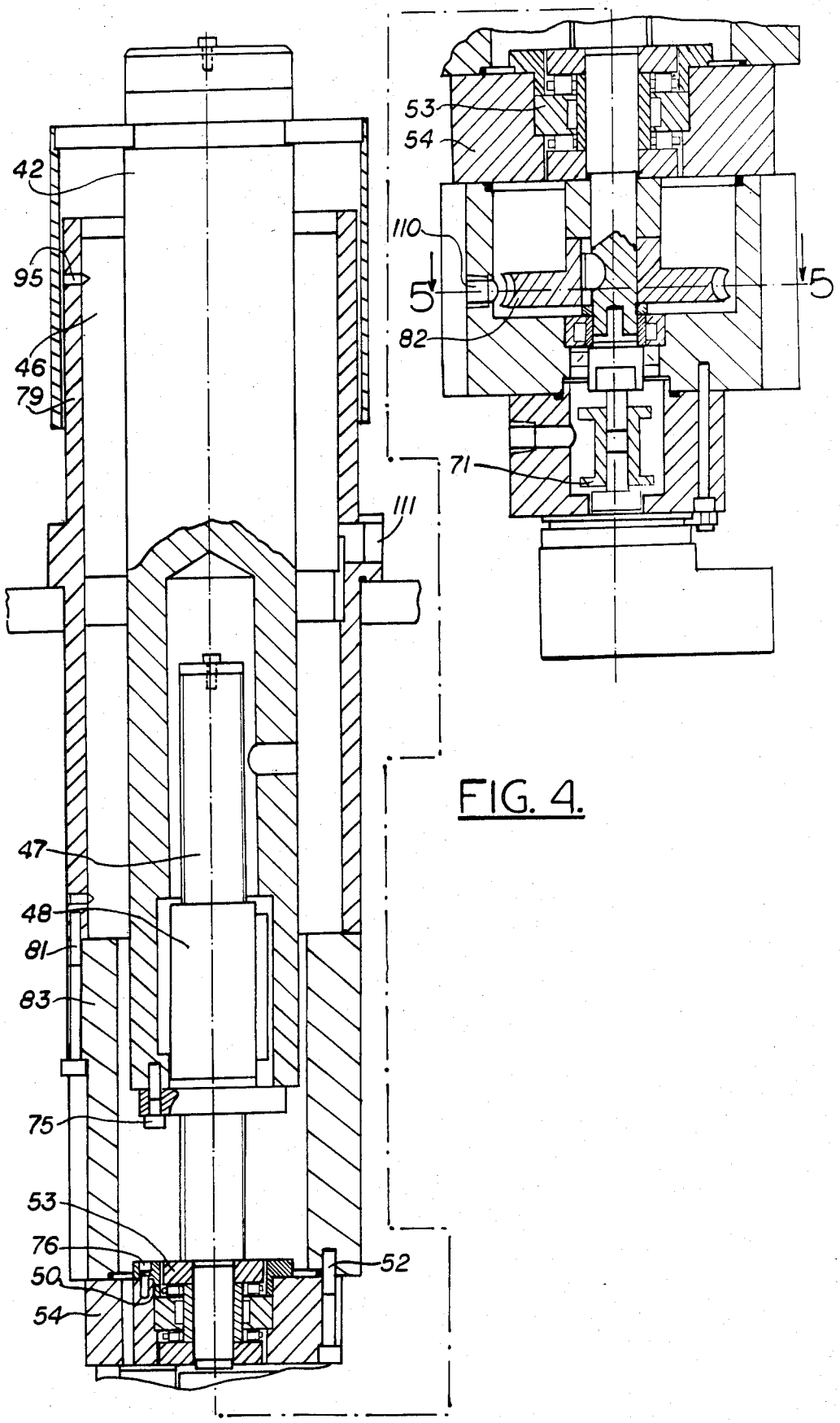
FIG. 4 is a partial longitudinal sectional view of the driving arrangement for the first main support post of the grinding wheel support arrangement.

There is illustrated in FIG. 4 a cross-sectional view of the guide rod 42 and the manner in which it is guided and mounted, as well as the drive for the grinding head, respectively grinding disc in the vertical direction.

The guide rod 42 is slidably, vertically mounted in the guide sleeve 46. The guide sleeve 46 is secured by means of screws 95 in the housing 79. The housing 79 serves as the real support for the guide sleeve 46 and the drive for reciprocally moving the guide rod 42. This housing 79 is firmly and fixedly mounted on the support table by means of threaded bolts 40 (see also FIG. 3). At the lower end of the housing 79 there is affixed, for purposes of facilitating the manufacture of the entire assembly, an intermediate housing 83 which is secured to the upper main housing 79 by threaded bolts 81. At the lower end of the intermediate housing 83 a support plate 54 is secured to the intermediate plate 83 by means of threaded bolts 52. A conventional combined radial, axial bearing 53 is mounted by means of a press ring 50 and the threaded bolts 76 in the support plate 54. The bearing 53 serves to support and guide a threaded spindle 47. A threaded sleeve 48 is threadably mounted on the sleeve 47 and this threaded sleeve 47 is secured by means of threaded bolts 75 on the guide rod 42. By rotating the threaded spindle 47 the task is fulfilled of linearly moving the guide bolt 42, respectively the grinding head, or grinding disc vertically in the direction of the double-arrow 101–102.

Figure 5:
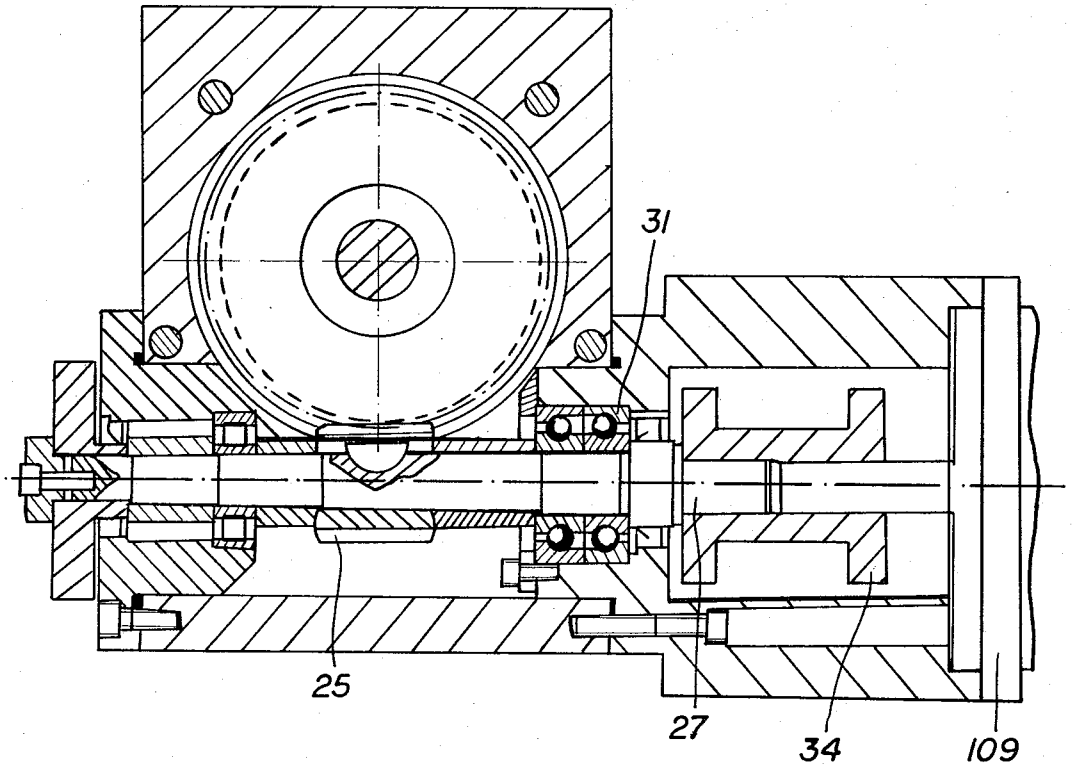
FIG. 5 is a cross-sectional view along line 5—5 of FIG. 4.

As shown in FIGS. 4 and 5 the rotating of the threaded spindle 47 can preferably be carried out by means of a drive including a worm gear wheel 82 and a worm gear 25 whose shaft is mounted by means of double-roller bearings 31 so that the worm gear shaft 27 is securely supported and guided. By means of a coupling 34 the worm gear shaft 27 is operatively connected to a drive motor 109. In order to achieve a variable adjustment of the grinding wheel, this drive motor 109 is preferably in the form of a DC current motor which is driven by way of a computerized control arrangement. In order to achieve a high degree of precision, a pulse encoder is directly mounted by means of a coupling 71 at the winding spindle 47. This pulse encoder detects the minutest rotational movement of the winding spindle 47 and transmits a corresponding pulse sequence to the computer control in order to effect a correct control of the drive motor 109.

In order to achieve a reliable operation during continuous production operation of the machine, it is necessary to compensate for heat expansion of certain machine parts, because such expansion may effect the precise positioning of the grinding disc. It is therefore necessary to keep a substantially constant temperature gradient during the operation of the grinding wheel support arrangement. In order to achieve this, there is provided an inlet 110 and an outlet 111 for coupling to the adjusting and controlling assembly an independent cooling unit which has the task of providing a temperature-stable medium, preferably lubricating oil, to the interior of the construction. This lubricating oil is fed into the inlet 110 and is circulated through the entire vertical assembly for the guide rod or shaft 42. Thereby an undesirable heating of the assembly, particularly of the guide shaft 42 is avoided and a more precise positioning of the machine, particularly over an extended period of time is secured. Simultaneously, the cooling medium (lubricating oil) also lubricates the movable parts of the machine thereby ensuring a precise vertical adjustment of the grinding wheel disc.

Although the invention is described and illustrated with reference to a plurality of embodiments thereof, it is to be expressly understood that it is in no way limited to the disclosure of such preferred embodiments but is capable of numerous modifications within the scope of the appended claims.

I claim:

1. In a grinding machine, an improved grinding wheel support arrangement, comprising in combination, a support table;

a first post threadably adjustably mounted in a direction normal to said support table;

a pair of second posts fixedly mounted on said support table;

a first support shaft rotatably supported in said pair of second posts;

an intermediate member secured to said first support shaft at one of its two ends and having a second support shaft secured to its other end;

a housing for supporting a drive motor;

a grinding wheel shaft rotatable in said housing;

a grinding wheel coaxially mounted on said grinding wheel shaft;

said first post being connected to said grinding wheel shaft so that their respective axes intersect each other;

a second support shaft being rotatably mounted in said housing and being parallel to said grinding wheel shaft; and said housing being pivotally connected to said intermediate member via said second support shaft.

2. In a grinding machine, the improved grinding wheel support arrangement as set forth in claim 1, wherein the center of gravity of said drive motor is substantially in alignment with said first and second support shafts.

3. In a grinding machine, the improved grinding wheel support arrangement as set forth in claim 1, wherein said pair of second posts and said housing respectively include a pair of opposite tapered roller bearings in which said first and second support drive shafts are respectively mounted.

4. In a grinding machine, the improved grinding wheel support arrangement as set forth in claim 1, including hydraulic clamping means operatively connected to said grinding wheel shaft for selectively clampingly holding said grinding wheel shaft in a predetermined position relative to said first post and selectively said grinding wheel shaft thereafter.

5. In a grinding machine, the improved grinding wheel support arrangement as set forth in claim 3, wherein said pair of tapered roller bearings are pretensioned by means of a pair coaxially mounted opposite rings.

6. In a grinding machine, the improved grinding wheel support arrangement as set forth in claim 1, including a second drive motor is drivingly connected to said first post to selectively advance or retract the first post to thereby move said grinding wheel shaft up or down with respect to said support table.

7. In a grinding machine, the improved grinding wheel support arrangement as set forth in claim 6, wherein said second drive motor is a DC current motor and includes a pulse encoder for controlling the movement of the DC current motor.

8. In a grinding machine, the improved grinding wheel support arrangement as set forth in claim 1, wherein said first post includes liquid medium cooling means operatively connected to said first post for cooling said first post during the operation of the grinding machine.

9. In a grinding machine, the improved grinding wheel support arrangement as set forth in claim 8, wherein said first post includes a sleeve in which a shaft is threadably mounted; said second DC current motor is drivingly connected to said threadably mounted shaft via a toothed rack and gear wheel, said gear wheel is coaxially arranged with respect to said threadably mounted shaft.

10. In a grinding machine, the improved grinding wheel support arrangement as set forth in claim 8, including a liquid cooling medium inlet and outlet in said sleeve for circulating a liquid cooling medium therethrough.

* * * * *